US006845562B2

(12) United States Patent
Evans

(10) Patent No.: US 6,845,562 B2
(45) Date of Patent: Jan. 25, 2005

(54) CAN OPENER

(76) Inventor: Robert Evans, 695 S. Raymond Ave., Pasadena, CA (US) 91105

( * ) Notice: Subject to any disclaimer, the term of this patent is extended or adjusted under 35 U.S.C. 154(b) by 0 days.

(21) Appl. No.: 10/300,129

(22) Filed: Nov. 19, 2002

(65) Prior Publication Data

US 2004/0093744 A1 May 20, 2004

(51) Int. Cl.[7] ..... B67B 7/72
(52) U.S. Cl. ..... 30/426; 30/433
(58) Field of Search ..... 30/426, 400, 416, 30/429, 430–433, 417, 418, 419, 420, 422

(56) References Cited

U.S. PATENT DOCUMENTS

| | | | | | |
|---|---|---|---|---|---|
| 1,539,211 | A | * | 5/1925 | Scruggs | 30/418 |
| 1,676,135 | A | | 7/1928 | Cuyler | |
| 1,986,657 | A | * | 1/1935 | West | 30/422 |
| 2,148,130 | A | | 2/1939 | Murdock | |
| 2,311,660 | A | | 2/1943 | Hothersall | |
| 2,354,469 | A | | 7/1944 | Lubetsky | |
| 2,640,257 | A | | 6/1953 | Berkman | |
| 2,843,931 | A | * | 7/1958 | Lindahl | 30/422 |
| 2,865,148 | A | * | 12/1958 | Moore | 451/549 |
| 2,903,927 | A | * | 9/1959 | Talge et al. | 81/3.32 |
| 3,002,275 | A | * | 10/1961 | Edlund | 30/422 |
| 4,053,981 | A | * | 10/1977 | Aberer | 30/419 |
| 4,227,473 | A | * | 10/1980 | Young | 413/78 |
| 4,365,417 | A | | 12/1982 | Rosendahl | |
| 4,574,482 | A | * | 3/1986 | van der Wouden | 30/422 |
| 4,833,783 | A | | 5/1989 | Davel | |
| 6,158,130 | A | * | 12/2000 | Chong | 30/418 |

* cited by examiner

*Primary Examiner*—Allan N. Shoap
*Assistant Examiner*—Phong Nguyen
(74) *Attorney, Agent, or Firm*—James E. Brunton

(57) ABSTRACT

A can opener for opening cans of various sizes having an operating handle, which when rotated in a first direction functions to bring a sharpened cutting wheel of the can opener from an elevated position into piercing engagement with the top of the can with the butting wheel n piercing engagement with the top of the can, continued rotation of the handle will cause rotation of the can and will cause the cutter wheel to cleanly cut the top of the can so that the top can be easily removed. Reverse rotation of the handle will cause the cutting wheel to disengage from the top of the can and to return to its elevated, starting position.

10 Claims, 9 Drawing Sheets

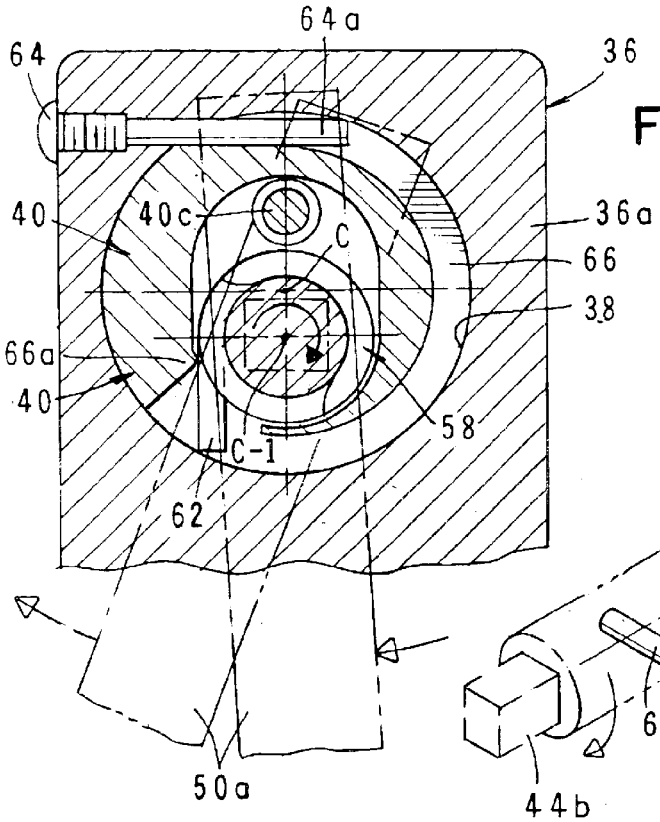
FIG. 15
FIG. 16
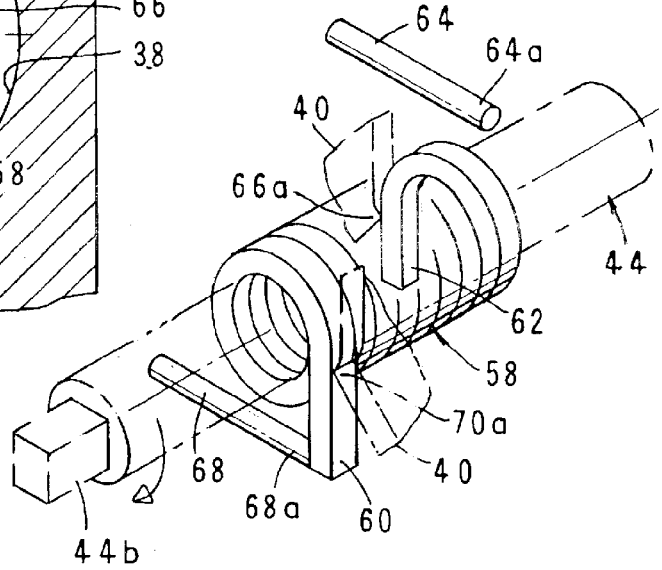
FIG. 17
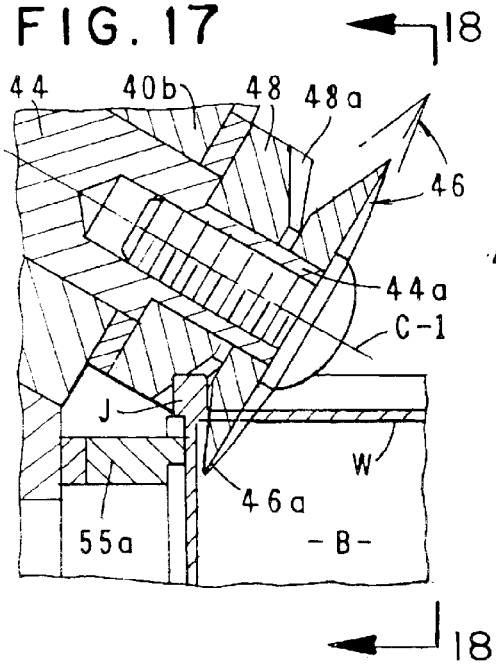
FIG. 18
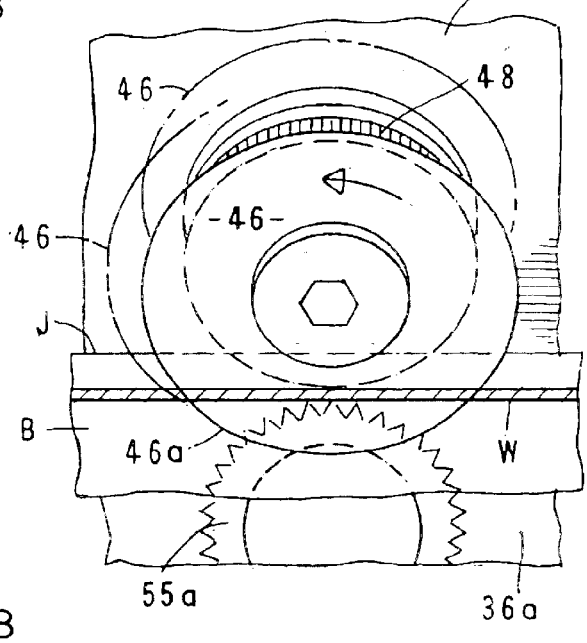

CAN OPENER

BACKGROUND OF THE INVENTION

1. Field of the Invention

The present invention relates generally to can openers. More particularly the invention concerns a hand operated, mechanical can opener.

2. Description of the Invention

A number of different designs of mechanically operated can openers have been suggested in the past. As a general rule, the prior art can openers comprise a traction wheel and a cooperating cutting wheel. The traction wheel is typically adapted to frictionally engage an annular abutment formed about the top periphery of the can and functions to drive the can opener around the top of the can while the sharpened cutting wheel cuts through the top wall of the can.

A major problem of prior art can openers of the aforementioned character resides in the fact that if the cutting wheel does not operate properly it can form small shavings that can undesirably contaminate the contents of the can.

Additionally, in the operation of certain prior art can openers, the cutting wheel fails to cleanly and effectively penetrate the top of the can as the traction wheel is moved into engagement with the annular abutment thereby making opening of the can unduly difficult. Another problem found in some prior art, manually operated can openers is a difficulty in keeping the opener in proper position on the can during the can opening process. Still another drawback of certain of the prior art manually operated can openers resides in the fact that in many cases a high degree of dexterity on the part of the user is required to properly use the can opener.

A quite popular type of prior art can opener is a hand operated can opener that includes a lever handle integrating a cutter at the end thereof to make a circumferential cut on a sealed cover of a can adjacent to a projecting edge joint formed between the sealed cover and a cylindrical wall of the can. A disadvantage of this type of can opener is that a substantial force is required to first pierce the sealed cover of the can and to then sever the cover from the body of the can. A can opener construction that somewhat alleviates the disadvantages of this latter type of can opener is disclosed in U.S. Pat. No. 2,354,467 issued to Lubetsky. The Lubetsky can opener includes a spindle, a crank for turning the spindle and a drive member fixed on the spindle for rotation therewith. The drive member is adapted to rotate around upon a peripheral margin formed proximate the upper end of the can. A blade that is also carried by the spindle is adapted to pierce the can end and cut the latter as the drive member travels around the margin of the can. A movable guide depends from the spindle and is adapted to engage an annular abutment on the can. A novel feature of the Lubetsky device resides in the provision of camming means that are adapted to move the movable guide into engagement with the abutment. The device also includes means provided on a crank for actuating the camming means.

SUMMARY OF THE INVENTION

An object of the invention is to provide an improved can opener of a simplified design which is easily operated and effectively overcomes the disadvantages of the prior art can openers.

Another object of the invention is to provide a can opener of the aforementioned character that is readily adjustable so that it can be used to open generally cylindrically shaped cans of various sizes.

Another object of the invention is to provide a can opener of the type described in the preceding paragraphs in which the operating handle, when rotated in a first direction to a first position, functions to bring the sharpened cutting wheel of the apparatus into piercing engagement with the top of the can. Continued rotation of the handle will cause rotation of the can and will cause the cutter wheel to cleanly cut the top of the can so that it can be easily removed.

Another object of the invention is to provide a can opener of the type described in the preceding paragraphs in which the operating handle, when rotated in a second, opposite direction, functions to move the sharpened cutting wheel of the apparatus out of piercing engagement with the top of the can so that the opened can may be expeditiously removed from the can opener.

Another object of the invention is to provide a can opener of the character described which includes a novel clutch arrangement comprising a wrap spring that circumscribes the cutter wheel spindle for controlling the movement of the cutter wheel into and out of cutting engagement with the can.

In summary, the present invention comprises a novel can opener for cutting the lid of a can having a generally cylindrically shaped body portion, a top wall connected to the body portion and a peripheral, outwardly projecting edge joint between the body portion and the top wall that includes a support assembly, a housing connected to the support, the housing having a longitudinal bore therethrough, a spindle housing rotatably carried within the longitudinal bore of the housing for rotation between first and second positions, the spindle housing having an axial centerline and a longitudinally extending bore having an axial centerline radially offset from the axial centerline of the spindle housing, a spindle disposed within the longitudinally extending bore of the spindle housing and operating means connected to the spindle for rotating the spindle between first and second positions to move the cutter wheel, which is connected to the spindle, into and out of engagement with the top of the can. For this purpose, a novel wrap spring circumscribes the spindle and is so constructed and arranged so that rotation of the spindle in a first direction to a first position will causes the wrap spring to drivably grip the spindle so that continued rotation of the spindle will cause rotation of spindle housing to the second position wherein the cutter wheel is moved into cutting engagement with the top of the can. Continued rotation of the spindle in the first direction to a second position will cause the wrap spring to release the spindle and enable rotation of the spindle and the cutter wheel independently of the spindle housing. As the spindle housing moves into the second position, a traction wheel connected to the housing will drivably engage the peripheral, outwardly projecting edge joint of the can to cause smooth rotation of the can. After the top of the can has been cut, rotation of the spindle in a second, opposite direction will causes the wrap spring to once again drivably grip the spindle and rotate the spindle housing to its starting position wherein the cutting wheel is withdrawn from cutting engagement with the top of the can.

BRIEF DESCRIPTION OF THE DRAWINGS

FIG. 15 is a cross-sectional view taken along lines 15—15 of FIG. 13.

FIG. 16 is an enlarged, generally perspective view of the wrap spring and spindle of the apparatus of the invention shown in a second position different from that shown in FIG. 7.

FIG. 17 is an enlarged fragmentary cross-sectional view of the cutting wheel of the apparatus of the invention shown in a can cutting configuration.

FIG. 18 is a view taken along lines 18—18 of FIG. 17.

DESCRIPTION OF THE INVENTION

Figure 1:
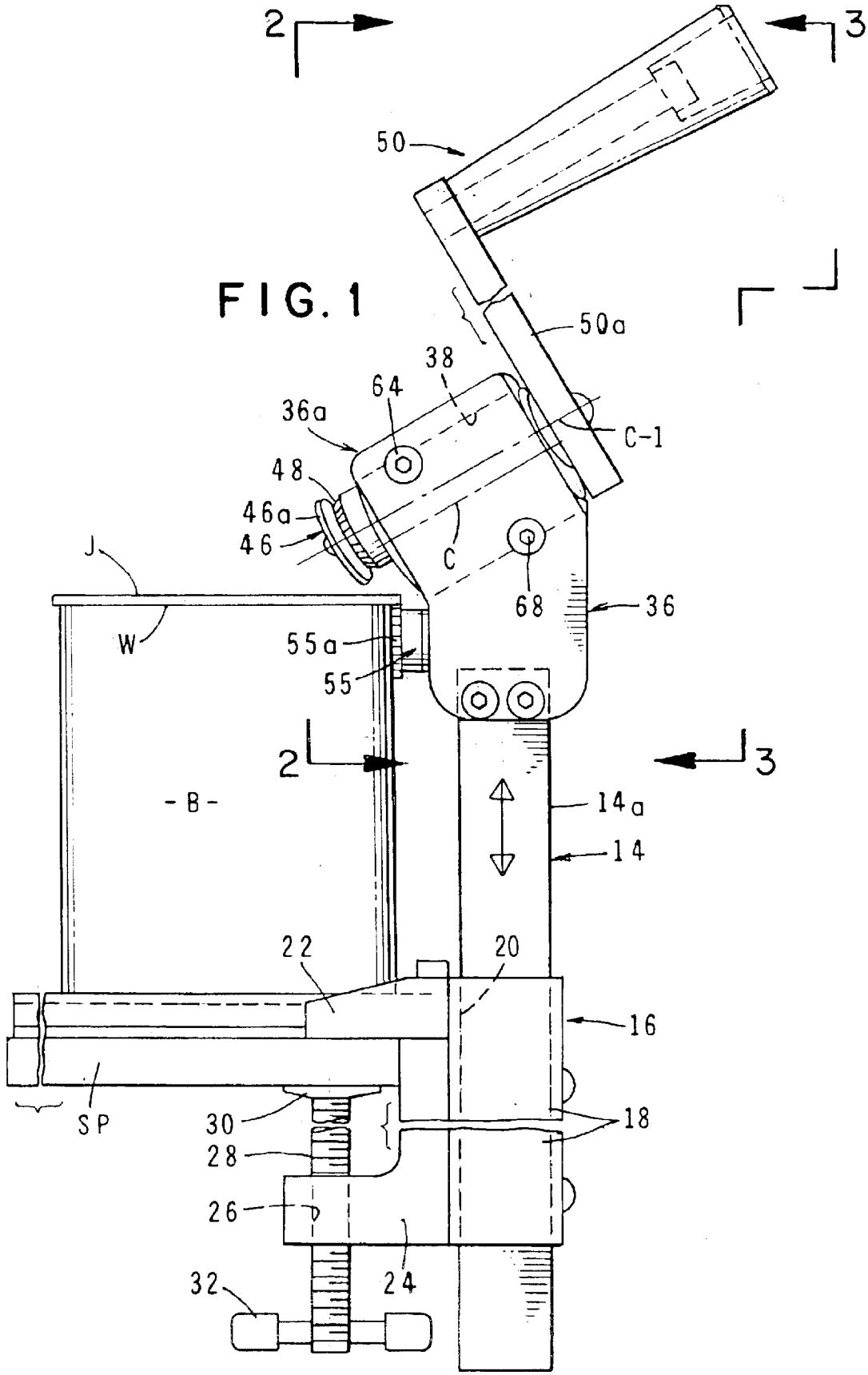
FIG. 1 side elevational view of one form of the can opener apparatus of the invention.
Figure 11:
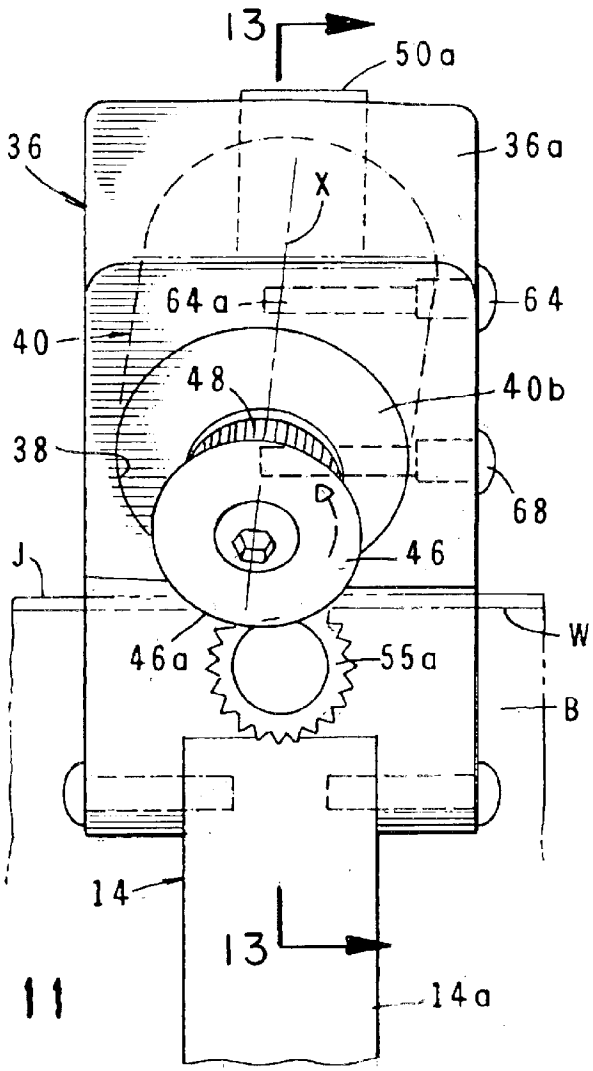
FIG. 11 is an enlarged, cross-sectional view taken along lines 11—11 of FIG. 10.

Referring to the drawings and particularly to FIGS. 1 through 7, one form of the can opener of the present invention is there shown. The can opener of the invention is specially designed for cutting a can having a body portion "B", a top wall "W" connected to the body portion and a peripheral, outwardly projecting edge joint "J" formed between the body portion "B" and the top wall "W" (FIGS. 1 and 11).

In the form of the invention shown in the drawings, the can opener comprises a support assembly 14 that includes an elongated, vertically extending rigid support member 14*a* and clamping means for adjustably affixing the support member to a supporting panel "SP" such as a counter or tabletop or the like. The clamping means here comprises a mounting assembly 16 that includes a body portion 18 having an opening 20 for telescopically receiving support member 14*a*. Mounting assembly 16 also includes a panel engaging, generally yoke shaped arm 22 that extends from body portion 18 for engagement with the upper surface of supporting panel "SP". Yoke shaped arm 22 also functions to center the can body relative to support member 14 and a manner depicted in FIGS. 1 and 8. Spaced apart from arm 22 and extending outwardly from body portion 18 is a second arm 24 that is provided with a threaded bore 26. Threadably received within threaded bore 26 is a threaded shaft 28 having at one end a clamping head 30 and having at the other end a transversally extending, finger engaging rod 32 for rotating threaded shaft 28.

Figure 3:
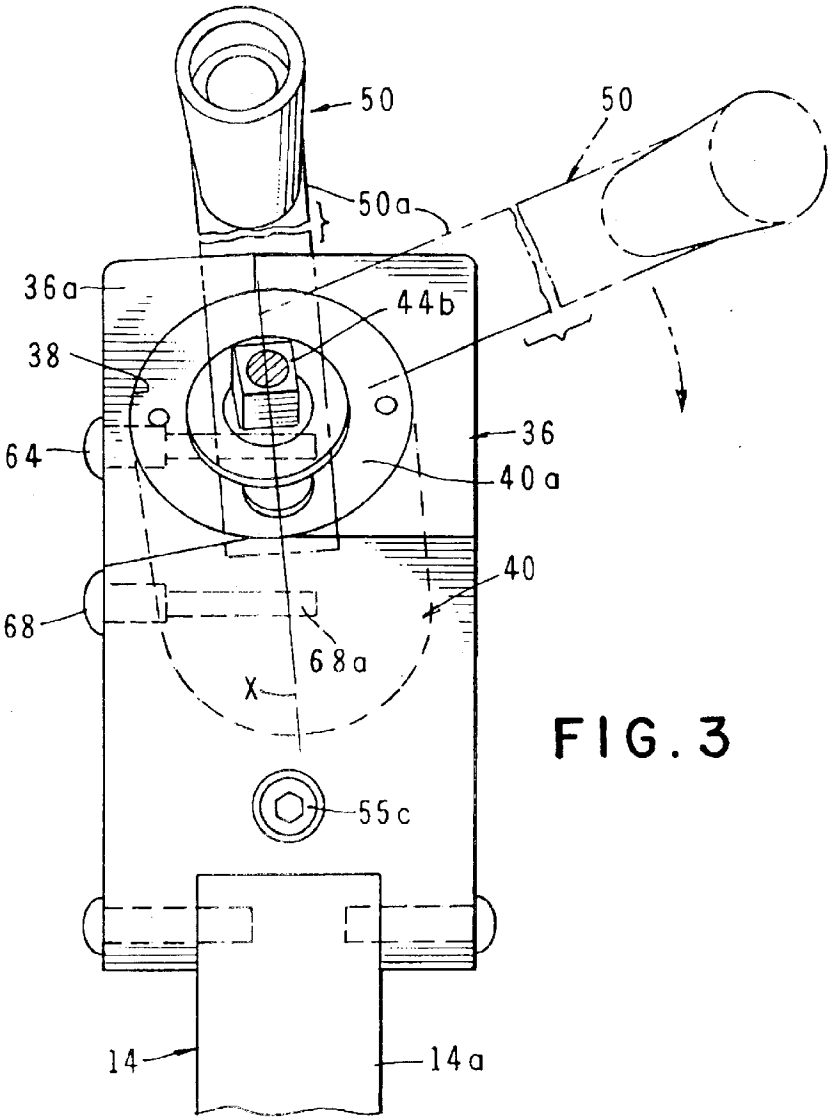
FIG. 3 is a view taken along lines 3—3 of FIG. 1.
Figure 2:
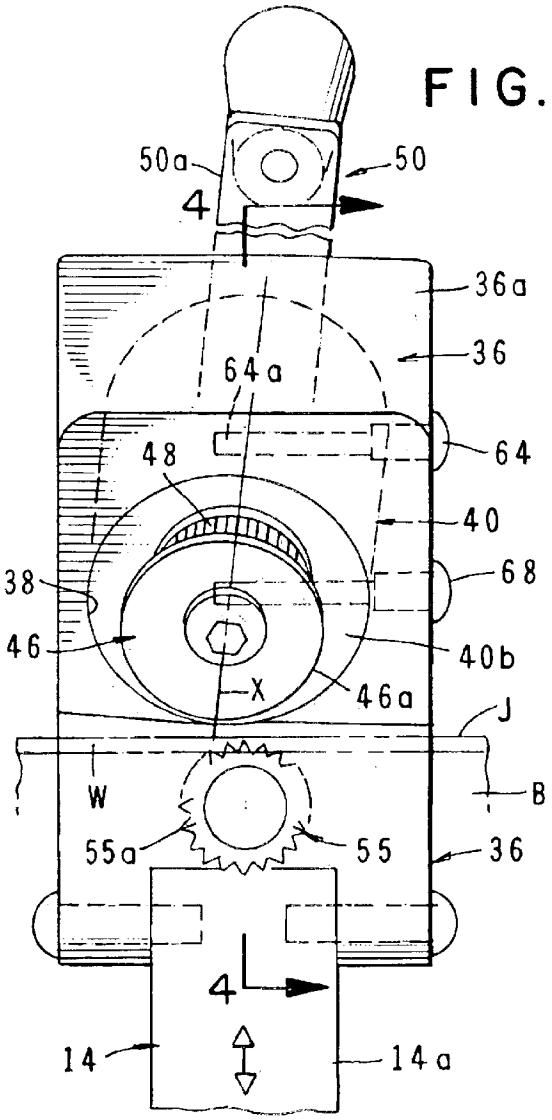
FIG. 2 is a view taken along lines 2—2 of FIG. 1.
Figure 5:
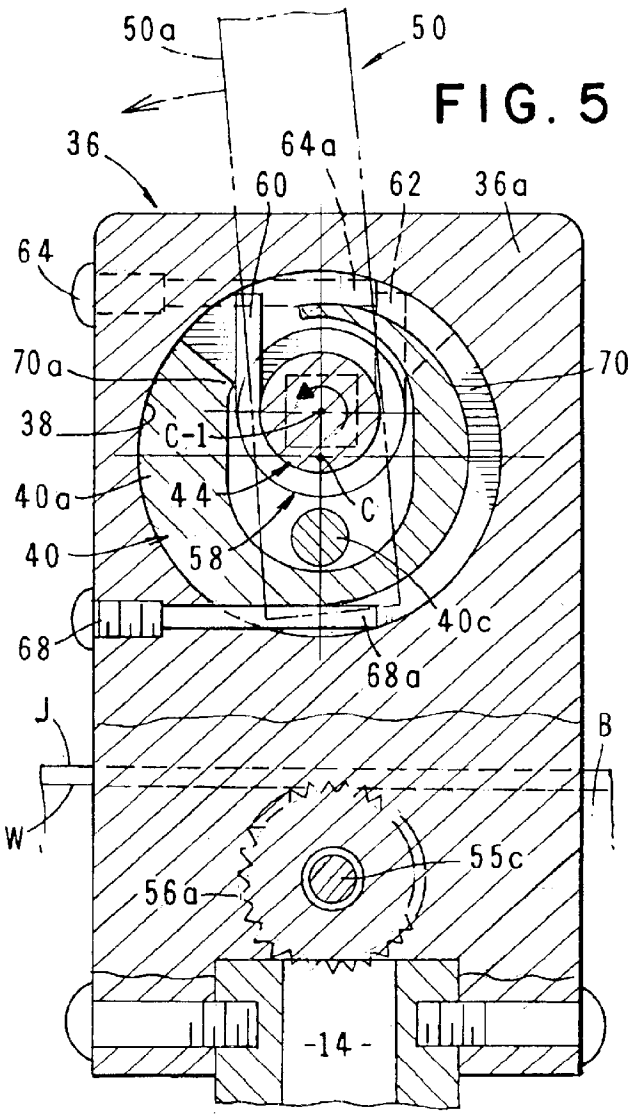
FIG. 5 is a cross-sectional view taken along lines 5—5 of FIG. 4
Figure 4:
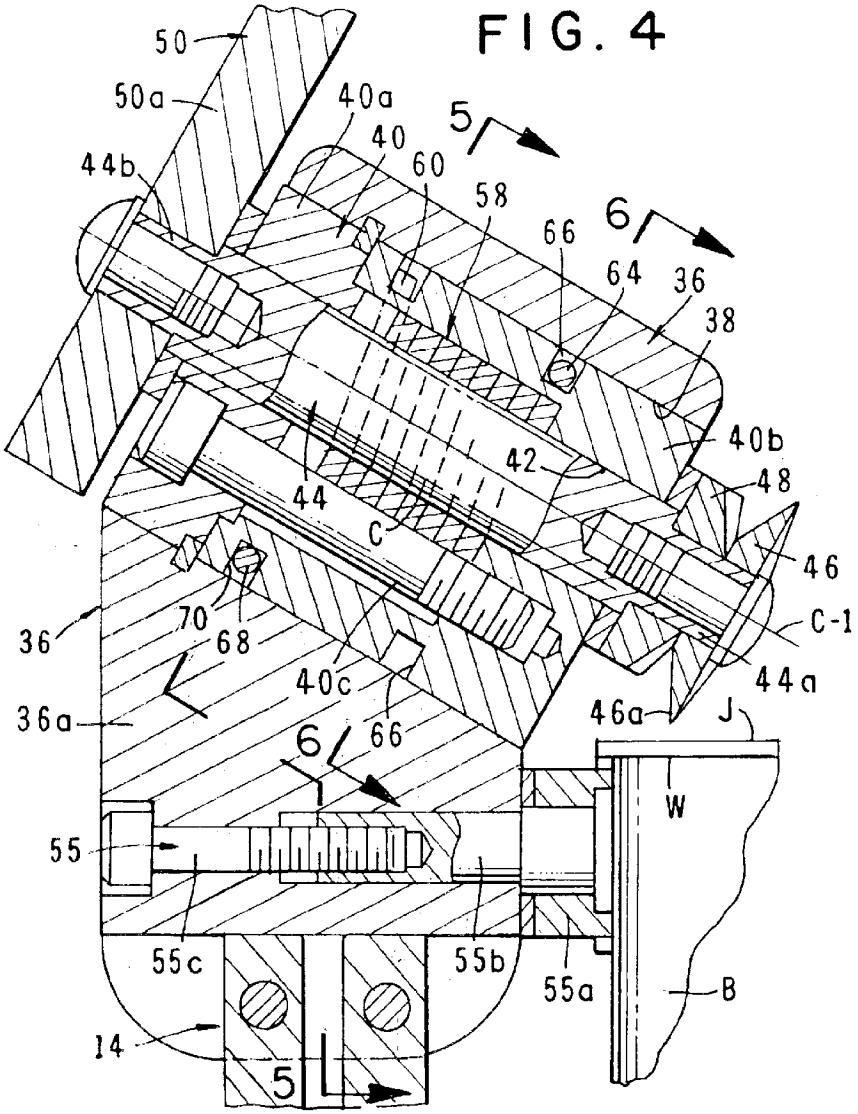
FIG. 4 is an enlarged cross-sectional view taken along lines 4—4 of FIG. 2.

Connected to the upper portion of support assembly 14 is a housing assembly 36 that includes a housing 36*a* having a longitudinal bore 38 therethrough (FIGS. 4 and 18). As best seen in FIG. 4, a spindle housing assembly 40 is mounted within longitudinal bore 38. Spindle housing assembly 40, which includes a first end portion 40*a* and a second portion 40*b* that are interconnected by a threaded connector 40*c*, is rotatable within bore 38 between a first position shown in FIG. 4 and a second position shown in FIG. 11. Spindle housing assembly 40 has an axial centerline "C" (FIG 5) and a longitudinally extending bore 42 having an axial centerline "C-1" that is radially offset from the center line "C" of spindle housing assembly 40 (see FIGS. 5 and 13). Rotatably carried within bore 42 is a spindle 44 that has first and second ends 44*a* and 44*b* respectively. First end 44*a* of spindle 44 extends outwardly from body 36 and, as best seen in FIG. 3, is generally square and cross-section. Connected to first end 44*a* for rotation therewith and is a cutter wheel 46 having a sharpened cutting edge 46*a* for cutting the top wall "W" of the can. Also connected to first end 44*a* of spindle 44 for rotation therewith is a traction wheel 48 that is adapted to engage the peripheral, outwardly projecting edge joint "J" of the can after cutter wheel 44 is moved into cutting engagement with the top wall of the can in a manner presently to be described. As shown in FIG. 17, traction wheel 48 is provided with a plurality of circumferentially spaced apart engaging teeth 48*a* to provide positive traction between the traction wheel and edge joint "J".

Operating means is connected to end 44*b* of spindle 44 for controllably rotating spindle 44 and also for controllably rotating spindle housing 40 between the first and second positions. In the present form of the invention, the operating means comprises an elongated handle or crank like assembly 50 that is connected to spindle 44 in the manner shown in the drawings.

In starting the can opening process, the housing assemblage 36 along with the crank assembly is first lifted so that the can can be positioned on the supporting panel "SP". This done, the assemblage is lowered to the position shown in FIGS. 1 and 2 where the can rim is disposed between the cutter wheel and the idler wheel 55*a* of idler wheel assembly 55. Idler wheel 55*a*, is of the general configuration shown in FIGS. 4 and 5 and is rotatably mounted on a shaft 55*b* that is carried by a threaded member 55*c* that is threadably connected to housing 36*a* in the manner shown in FIG. 4 of the drawings.

To begin the can opening process, the handle 50*a* of the operating means is rotated in a clockwise direction causing concomitant rotation of spindle 44 in a clockwise direction.

Figure 7:
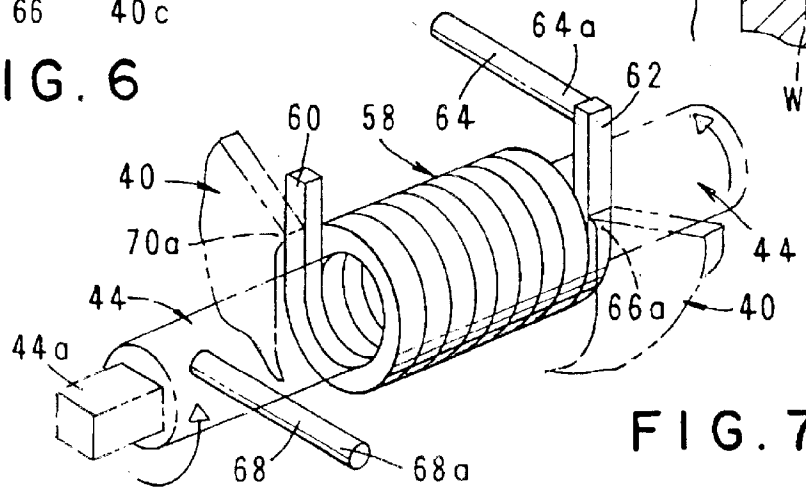
FIG. 7 is an enlarged, generally perspective view of one form of the wrap spring and spindle of the apparatus of the invention shown in a first starting position.

Forming an important aspect of the apparatus of the present invention is clutch means for controlling the rotation of the spindle housing assembly 40 within bore 38 of housing 36*a*. This novel clutch means is here provided in the form of a conventional wrap spring 58 that circumscribes a portion of spindle 44. As best seen in FIG. 7 wrap spring 58 includes first and second tangs 60 and 62, the purpose of which will presently be described. FIG. 7 illustrates the position of the wrap spring and spindle when the handle 50*a* has been rotated in a counter-clockwise direction and into the can opening starting position shown in FIGS. 4 and 5. In this position, second tang 62 is in engagement with the inboard end 64*a* of a transversely extending stop pin 64 that is threadably connected to housing 36*a* (FIG. 7). Second tang 62 is also in engagement with the end wall 66*a* of a groove 66 formed in spindle housing portion 40*b* (see also FIG. 20). Groove 66 comprises a part of the guide means of the invention for guiding travel of the first and second tangs. Rotation of handle 50*a* and spindle 44 in a counter-clockwise direction will cause tang 62 of the wrap spring 58 to engage stop pin 64 and will cause it to tend to unwind or disengage spindle 44 allowing it to freely rotate within the wrap spring. However, rotation of handle 50*a* and spindle 44 in the opposite, clockwise direction will permit the wrap spring to return to its normal at rest position and to drivably engage the spindle causing the spindle and wrap spring to rotate as a unit. This clockwise rotation of the handle will also cause tang 62 to exert a force on channel end portion 66*a* and to thereby impart rotation to spindle housing assembly 40 in a manner to rotate the assembly to the intermediate position shown in FIGS. 8 and 9.

Figure 8:
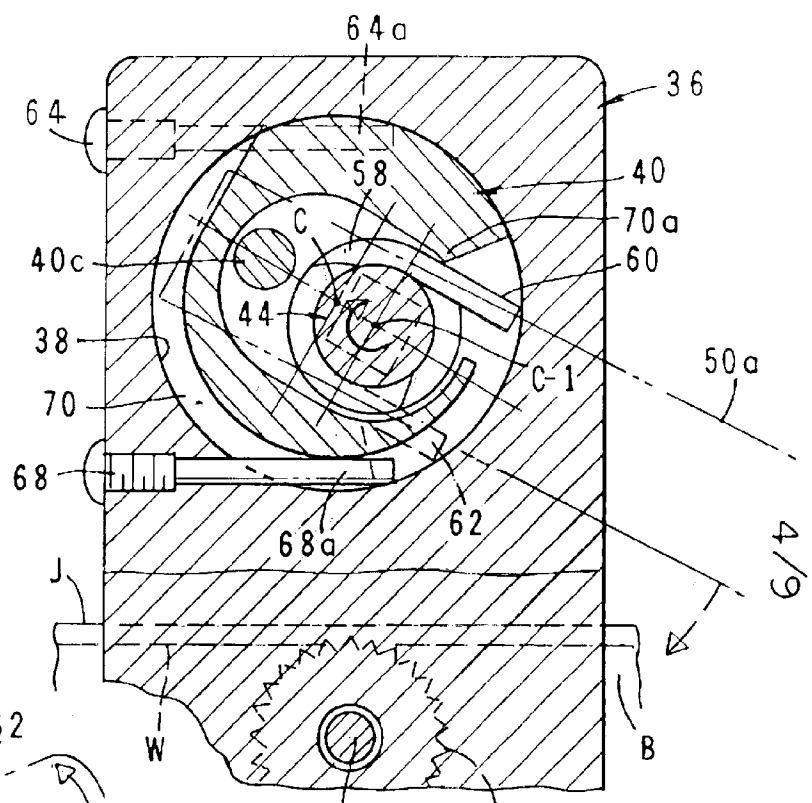
FIG. 8 is a cross-sectional positioned view similar to FIG. 6, but showing the crank handle of the apparatus moved from a first to a second intermediate position and showing the travel of the front tang of the wrap spring.
Figure 6:
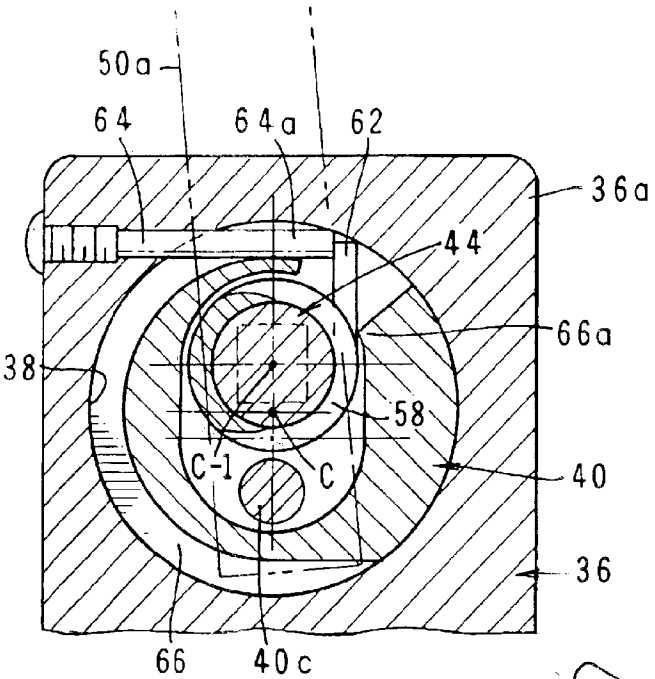
FIG. 6 is a cross-sectional view taken along lines 6—6 of FIG. 4.
Figure 9:
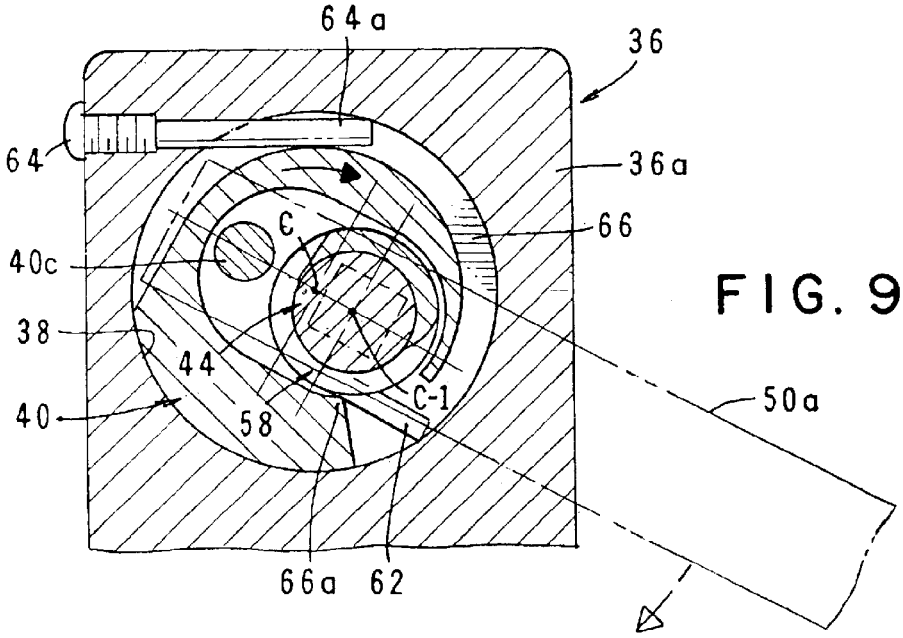
FIG. 9 is a cross-sectional position view similar to FIG. 8, but illustrating the travel of the rear tang of the wrap spring.
Figure 10:
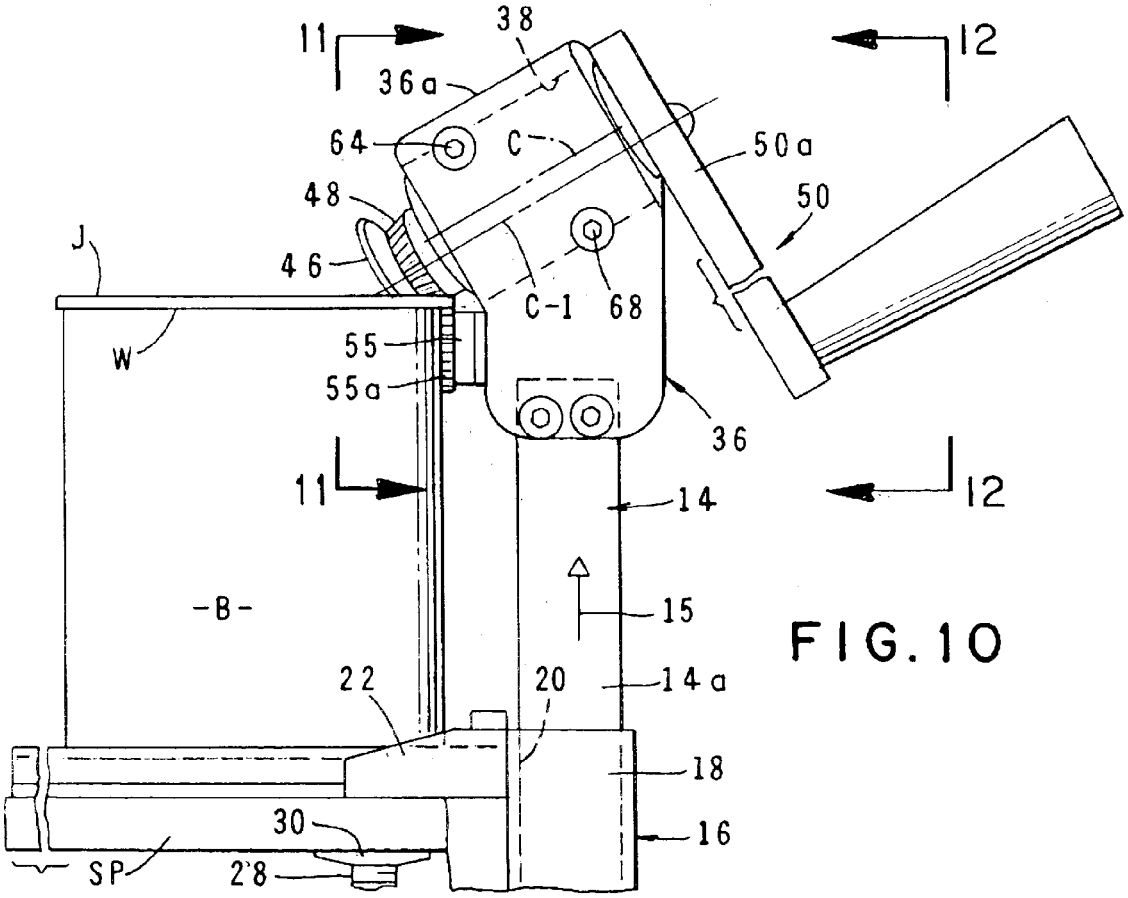
FIG. 10 is a side-elevational view similar to FIG. 1, but showing the crank handle of the apparatus moved from a first to a second position.

Continued rotation of the handle assembly past the intermediate position shown in FIGS. 8 and 9 will cause the cooperating components to next move into the position shown in FIGS. 10, 11, 13 and 14. More particularly, since the spindle and wrap spring are mounted eccentrically within spindle housing assembly 40, rotation of the spindle housing assembly from the starting position shown in FIGS. 4 and 5 to the position shown in FIGS. 13 and 14 will cause the spindle and the cutter wheel that is attached thereto to move into the can cutting position shown in FIGS. 11, 13 and 14. At the same time, the supporting assembly 14 will move upwardly in the direction of the arrow 15 of FIG. 10 bringing the idler wheel 55*a* into engagement with the edge join "J" in the manner shown in FIG. 10.

Figures 13, 14:
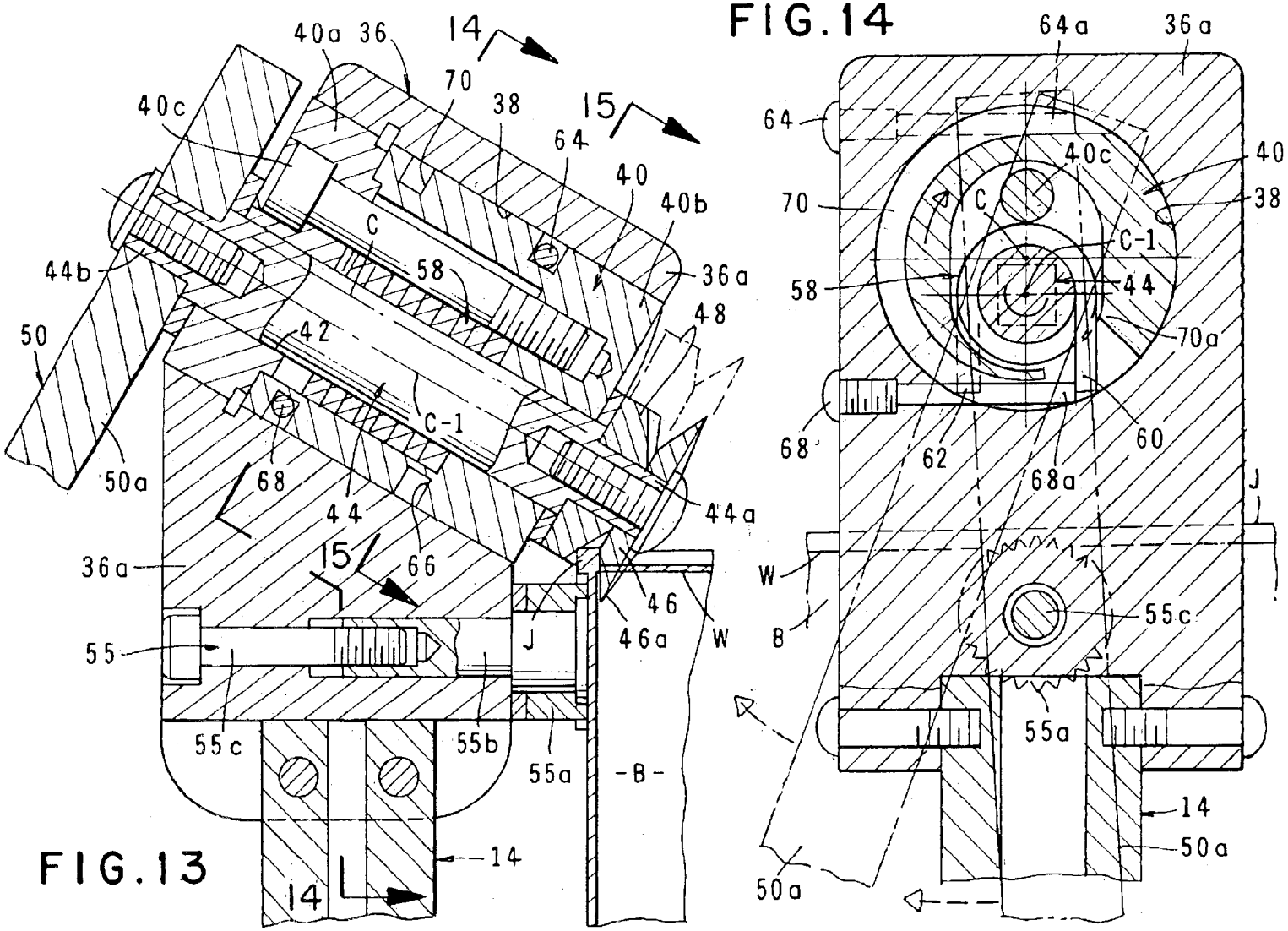
FIG. 13 is a cross-sectional view taken along lines 13—13 of FIG. 11.
FIG. 14 is a cross-sectional view taken along lines 14—14 of FIG. 13.

When the assemblage made up of spindle 44 and wrap spring 58 reaches the can cutting position shown in FIGS. 11, 13 and 14, tang 60 will move into engagement with the inboard end 68*a* of a second transversely extending stop pin 68 (see FIGS. 14 and 16). Continued rotation of the spindle in a clockwise direction will cause the wrap spring to "unwind" and disengage the spindle thereby permitting the spindle to freely rotate within the wrap spring and within spindle housing assembly 40.

Figures 19, 20:
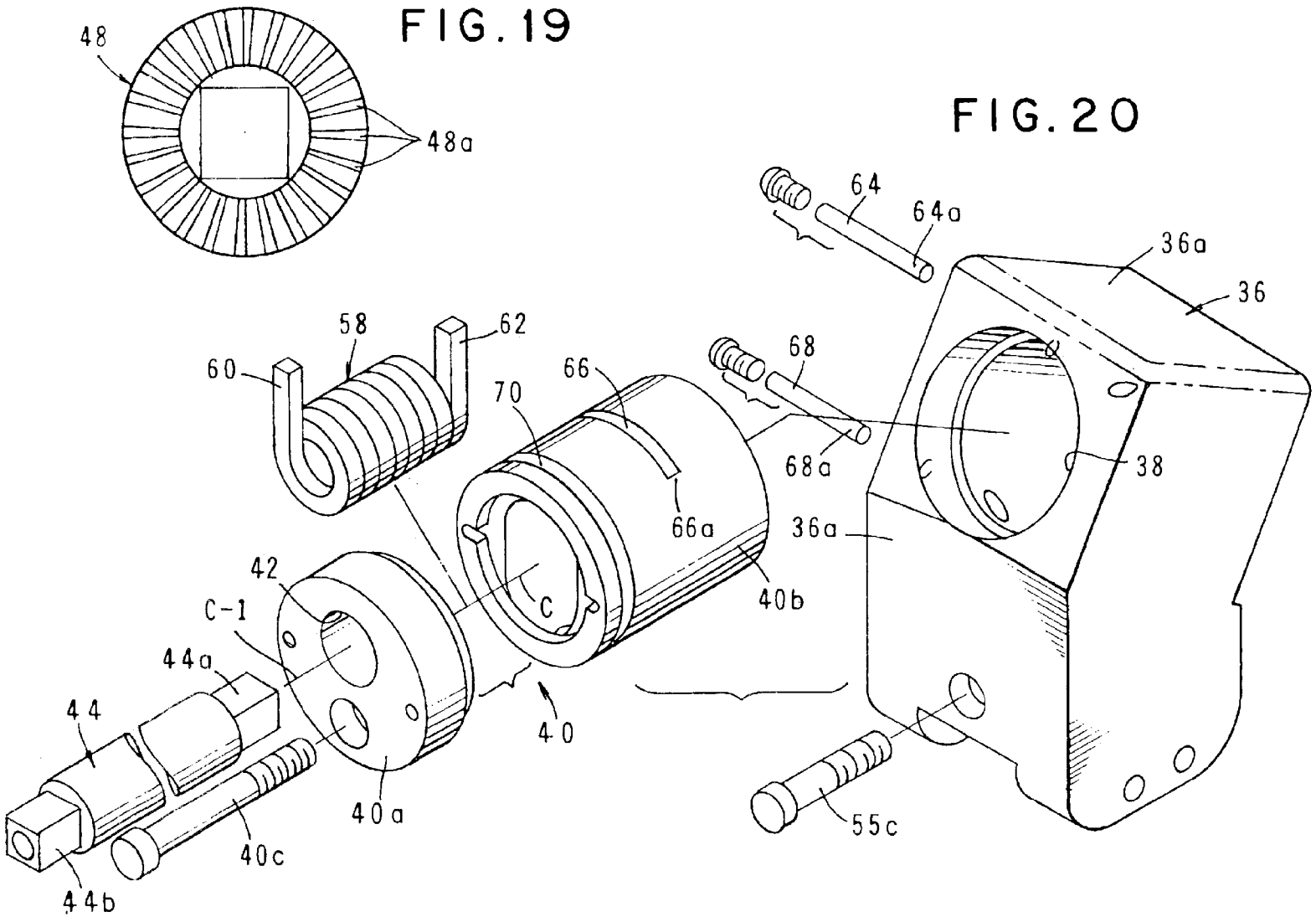
FIG. 19 is a plan view of one form of the traction wheel and spindle of the apparatus of the invention.
FIG. 20 is an enlarged, generally perspective, exploded view of the various cooperating components of the apparatus of the invention.

As best seen by referring to FIG. 20, assembly portion 40*b*, spindle housing is also provided with a second guide channel or groove 70 which receives and guides the travel of tang 60 as spindle 44 is rotated between the starting and can cutting positions. Guide channel 70, which also forms a part of the guide means of the invention, has an end portion 70*a* that engages tang 60 in the manner shown in FIG. 7. With the wrap spring of the clutch means disengaged from the spindle, further rotation of the handle assembly in a clockwise direction, will cause rotation only of spindle 44 which, in turn, will cause the traction wheel 48 to engage the peripheral joint "J" of the can in a manner to controllably rotate the can and cause the cutter wheel to cleanly cut the top of the can at a location proximate the peripheral joint.

Figure 12:
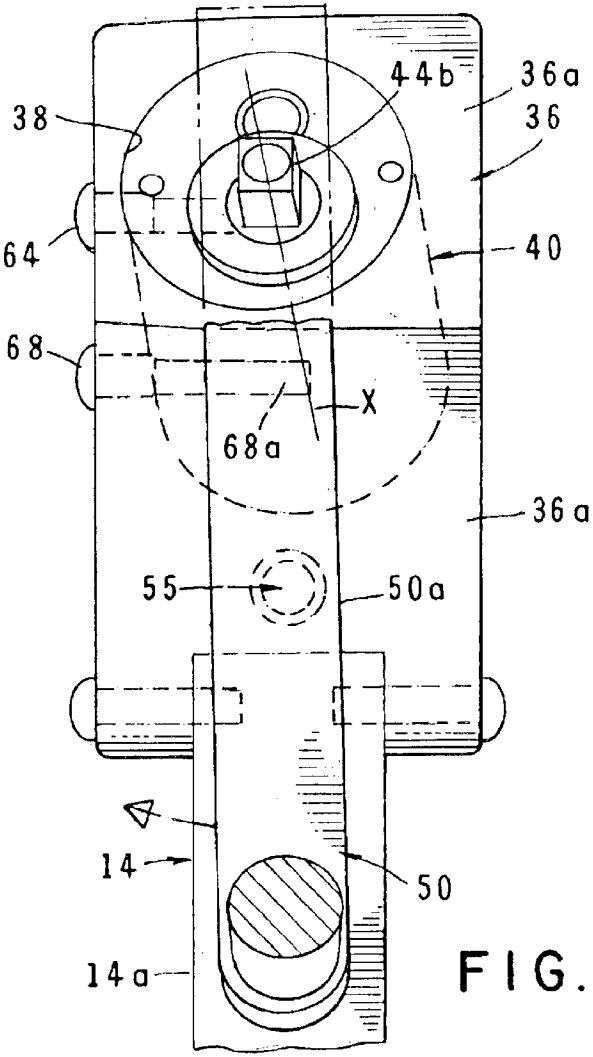
FIG. 12 is an enlarged, cross-sectional view taken along lines 12—12 of FIG. 10.

After the top of the can has been cut, the handle assembly 50 is rotated in a counter-clockwise position causing tang 60 to move away from stop pin 68 and causing the wrap spring to once again return to its normal at rest position and to drivably engage the spindle. Continued rotation of the spindle in the counter-clockwise direction will cause the spindle and the spindle housing assembly 40, which is now driven as a result of tang 62 engaging shoulder 66*a* (FIG. 16) to move into the position shown in FIGS. 4 and 5. As indicated in FIG. 12, the axis "X" of the housing assembly is skewed at an angle so as to make the can lid or top rise at the end of the cut. In the position shown in FIGS. 4 and 5, tang 62 will once again engage stop pin 64 in the manner shown in FIG. 7 unwinding the wrap spring and permitting the spindle to rotate freely within the wrap spring. With the spindle housing assembly 40 in this starting position, another can can be opened in the same manner as described in the preceding paragraphs.

Having now described the invention in detail in accordance with the requirements of the patent statutes, those skilled in this are will have no difficulty in making changes and modifications in the individual parts or their relative assembly in order to meet specific requirements or conditions. Such changes and modifications may be made without departing from the scope and spirit of the invention, as set forth in the following claims.

I claim:

1. A can opener for cutting a can having a body portion and a top wall connected to the body portion, said can opener comprising:

(a) a support assembly;

(b) a housing assembly connected to said support assembly, said housing assembly including a housing having a longitudinal bore therethrough;

(c) a spindle housing having an axial center line rotatably carried within said longitudinal bore of said housing for rotation between first and second positions, said spindle housing also having a longitudinally extending bore having an axial centerline radially offset from said axial centerline of said spindle housing;

(d) a spindle rotatably carried within said longitudinally extending bore of said spindle housing;

(e) operating means connected to said spindle for rotating said spindle and said spindle housing between first and second positions;

(f) a cutter wheel connected to said spindle for rotation therewith for cutting the top wall of the can; and (g) clutch means mounted within said housing for controlling the rotation of said spindle housing, said clutch means comprises a wrap spring carried by said spindle, said wrap spring being movable from an engaging position wherein said wrap spring is in driving engagement with said spindle to a disengaged position wherein said wrap spring is disengaged from said spindle.

2. The can opener as defined in claim 1 in which said housing assembly further includes a pair of spaced-apart stop pins and in which said wrap spring includes first and second tangs movable into engagement with said stop pins upon rotation of said spindle.

3. A can opener that can be secured to a planar member for cutting a can having a body portion, a top wall connected to the body portion and a peripheral, outwardly projecting edge joint between the body portion and the top wall, said can opener comprising:

(a) a support assembly including a rigid support member and clamping means for adjustably securing said rigid support member to the planar member;

(b) a housing assembly connected to said support assembly, said housing assembly including a housing having a bore therethrough and further including first and second spaced apart, transversely extending stop pins;

(c) a spindle housing rotatably carried within said longitudinal bore of said housing for rotation between first and second positions, said spindle housing having an axial centerline and a longitudinally extending bore having an axial centerline radially offset from said axial centerline of said spindle housing;

(d) a spindle rotatably carried within said longitudinally extending bore of said spindle housing;

(e) a handle assembly connected to said spindle for rotating said spindle between said first and second positions and for rotating said spindle housing between first and second positions;

(f) clutch means carried by said housing assembly for controlling the rotation of said spindle housing, said clutch means comprising a wrap spring circumscribing said spindle and including first and second tangs selectively movable into engagement with said first and second stop pins; and (g) a cutter wheel connected to said spindle for rotation therewith for cutting the top wall of the can.

4. The can opener as defined in claim 3 in which said spindle housing is provided with guide channels for guiding travel of said first and second tangs.

5. A can opener that can be secured to a planar member for cutting a can having a body portion, a top wall connected to the body portion and a peripheral, outwardly projecting edge joint between the body portion and the top wall, said can opener comprising:

(a) a support assembly including a rigid support member and clamping means for adjustably securing said rigid support member to the planar member;

(b) a housing assembly connected to said support assembly, said housing assembly including a housing having a bore therethrough;

(c) first and second stop pins connected to said housing;

(d) a spindle housing rotatably carried within said longitudinal bore of said housing for rotation between first and second positions, said spindle housing having an axial centerline and a longitudinally extending bore having an axial centerline radially offset from said axial centerline of said spindle housing;

(e) a spindle rotatably carried within said longitudinally extending bore of said spindle housing;

(f) a handle assembly connected to said spindle for rotating said spindle between said first and second positions and for rotating said spindle housing between first and second positions;

(g) clutch means carried by said housing assembly for controlling the rotation of said spindle housing, said clutch means comprising a wrap spring circumscribing said spindle, said wrap spring having a first tang movable into engagement with said first stop pin upon rotation of said spindle and having a second tang movable into engagement with said second stop pin upon rotation of said spindle; and (h) a cutter wheel connected to said spindle for rotation therewith for cutting the top wall of the can; and (i) a traction wheel connected to said spindle for rotation therewith and for engagement with the peripheral, outwardly projecting edge joint of the can.

6. The can opener as defined in claim 5 in which said clamping means comprises a mounting assembly that includes a body portion having an opening for telescopically receiving said support member.

7. The can opener as defined in claim 6 in which said clamping means comprises a mounting assembly having a generally yoke shaped arm for engagement with the planar member and for locating the can relative to said rigid member.

8. The can opener as defined in claim 7, further including an idler wheel carried by said support assembly for engaging the body of the can.

9. The can opener as defined in claim 8 in which said spindle housing is provided with guide channels for guiding travel of said first and second tangs.

10. The can opener as defined in claim 9 in which said guide means comprises first and second spaced-apart guide channels.

* * * * *